United States Patent [19]

Duncan

[11] Patent Number: 4,640,049

[45] Date of Patent: Feb. 3, 1987

[54] SAFETY DEVICES FOR OVERHEAD GARAGE DOOR SPRINGS

[76] Inventor: Joseph L. Duncan, 224 Laurie Dr., Pittsburgh, Pa. 15235

[21] Appl. No.: 792,443

[22] Filed: Oct. 29, 1985

[51] Int. Cl.[4] ..... E05D 15/22

[52] U.S. Cl. ..... 49/197; 267/74

[58] Field of Search ..... 49/197; 267/74; 160/191

[56] References Cited

U.S. PATENT DOCUMENTS

| | | | |
|---|---|---|---|
| 1,983,856 | 12/1934 | Johnson | 160/191 |
| 2,758,833 | 8/1956 | Harbert | 267/74 |
| 3,429,072 | 2/1969 | Sammons | 267/74 X |
| 3,575,404 | 4/1971 | Wesch | 267/74 |
| 3,958,367 | 5/1976 | Fairman | 49/197 |
| 4,082,133 | 4/1978 | Halopoff | 49/197 |

*Primary Examiner*—Kenneth Downey

*Attorney, Agent, or Firm*—Buell, Ziesenheim, Beck & Alstadt

[57] ABSTRACT

A safety device for overhead garage and like door structures having a counterbalance spring structure including a coil spring which includes a safety cable extending through the open center of the coil spring and adjustably anchored at each end to the garage structure so as to be placed under sufficient tension to contain the spring against substantial horizontal or vertical movement in the event of breakage.

6 Claims, 6 Drawing Figures

SAFETY DEVICES FOR OVERHEAD GARAGE DOOR SPRINGS

This invention relates to safety devices for overhead garage door springs and particularly to cable safety devices for overhead garage door springs.

Overhead garage doors are generally provided with counterbalance springs which are used to assist in the lifting and opening of the doors. These springs must be relatively powerful and when stretched, as with the doors closed, are under a great tension. These springs, after considerable use, are subject to failure for one or more of a variety of reasons including crystallization, fatigue and other reasons. When this happens under tension, broken pieces of the spring thrash around with great force and frequently serious damage automobiles and other objects within the garage as well as to the building itself.

It is possible to reduce the likelihood of such tension breakage by various means such as longer or heavier springs. Such means as are available are expensive and are an appreciable cost problem and therefore are not an economical solution. The problem has long been recognized and various solutions have been proposed. Among the proposed solutions are those set out in U.S. Pat. No. 3,958,367 and 4,082,133. U.S. Pat. No. 3,958,367, a cable is passed through the spring and fixed at one end to an end bracket and at the other end held by a spring. Such a device is not sufficiently taut to hold a spring which is under great tension and if the door spring breaks it can still thrash around sufficiently to do damage to vehicles in the garage. U.S. Pat. No. 4,082,133 uses a solid rod extending through the spring. The rod is fixed at one end to the door frame and the other end protrudes through a hole in the spring bracket and is bent loosely around the bracket. Here again the rod is free to flex because of the loose end and like that of U.S. Pat. No. 3,958,367 will permit sufficient movement to cause damage to a vehicle in the garage in the case of a break in the door spring.

I have discovered that all of these problems can be solved by using a cable passed axially through the door spring and held under tension against flexure.

I provide a garage or like door structure having a door opening, a door movable between a closed position and an open position, guide tracks against opposite sides of the door opening and having a vertical section parallel to the door opening sides and a horizontal section, rollers on the sides of the door moving in said guide tracks to carry the door from a vertical closure position in the door opening to a horizontal open position above the level of the door opening top, a counterbalance spring assembly for said door including a coil spring mounted for movement in tension parallel to and adjacent said horizontal overhead section, anchor means in the garage structure adjacent the horizontal section of the guide tracks and spaced from the door opening, attaching means at each end of the counterbalance spring assembly, one attachment means at one end engaging said anchor means, a fixed pulley on the garage structure above the door opening and in general alignment with the anchor means on a line generally parallel to the horizontal section of the guide rails, a movable pulley assembly connected to the attachment means at the opposite end of the counterbalance spring assembly, cable means connecting said movable pulley assembly to the garage door over the fixed pulley, a safety cable fixed at one end to the anchor means in the garage structure, an adjustable anchor means in the garage structure adjacent the fixed pulley and aligned with the fixed pulley and anchor means, said safety cable extending through the coil spring of the spring assembly and attached at its other end to the adjustable anchor means, said adjustable anchor means being adjustable to place the cable under sufficient tension that a broken coil spring will be retained or said safety cable against substantial movement relative to the horizontal section of the guide rails. Preferably the fixed pulley is attached to the garage structure above the door opening and has guide means for the safety cable and adjustable anchor means. The movable pulley assembly also preferably carries guide means for the safety cable.

In the foregoing general description I have set out certain objects, purposes and advantages of this invention. Other objects, purposes and advantages of this invention will be apparent from a consideration of the following description and the accompanying drawings in which.

Figure 1:
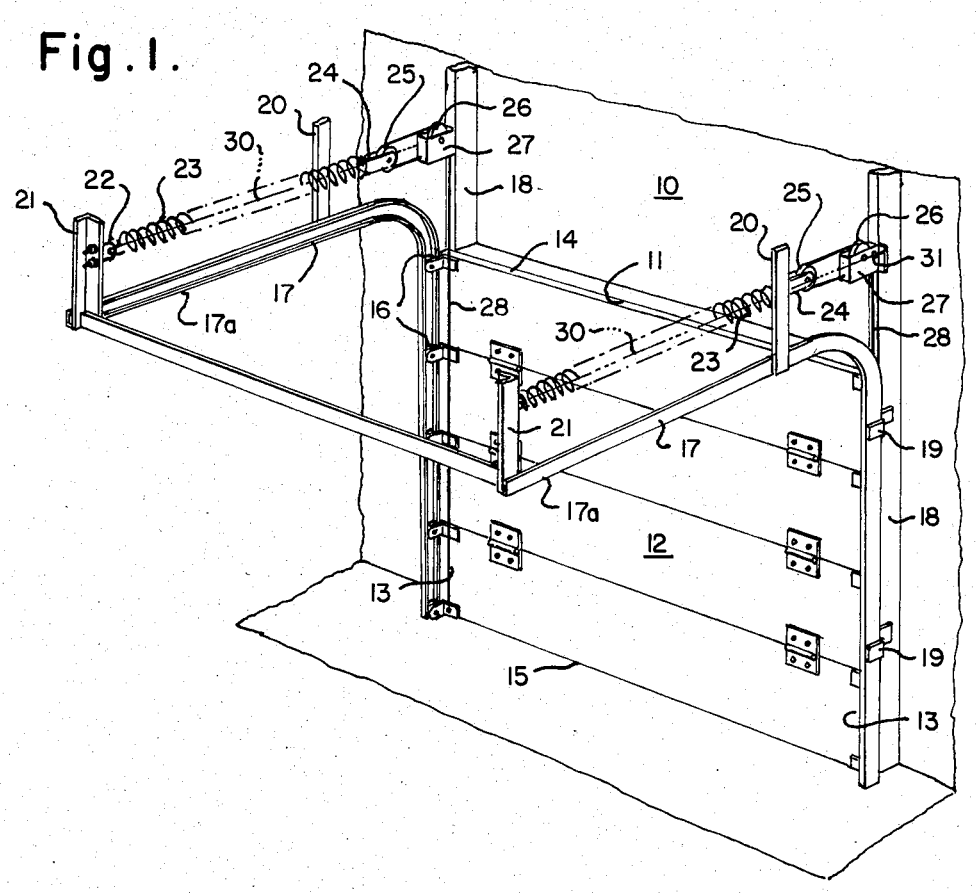
FIG. 1 is an isometric view of an overhead garage door incorporating the safety device of this invention.
Figure 2:
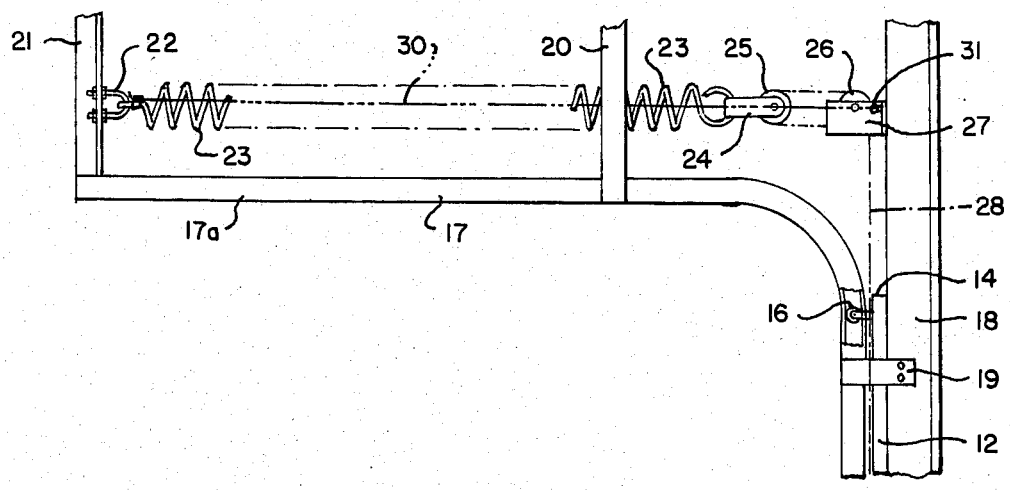
FIG. 2 is an enlarged fragmentary side elevational view of the horizontal track and safety device of this invention.
Figure 3:
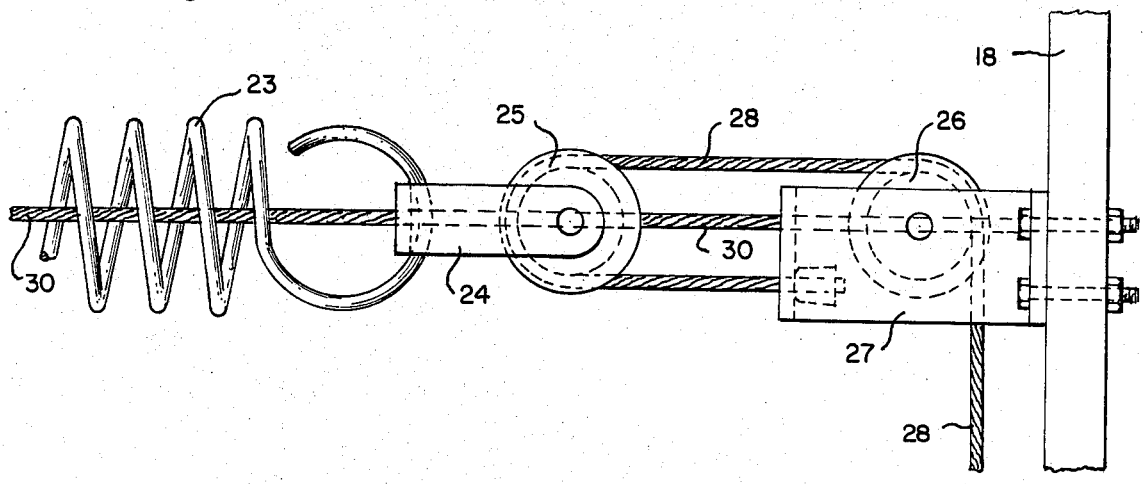
FIG. 3 is an enlarged fragmentary side elevational view of the adjustable anchor end of the safety device of this invention.
Figure 4:
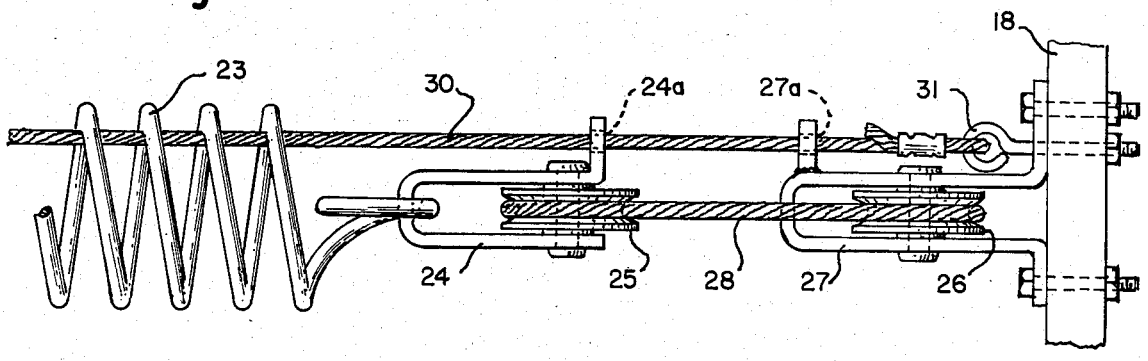
FIG. 4 is an enlarged fragmentary top plan view of the adjustable anchor end as shown in FIG. 3.

Referring to the drawings I have illustrated a garage structure 10 having an opening 11 closed by a door 12 made up of a plurality of side by side hinged horizontal sections. The door 12 has opposite side edges 13 and top and bottom edges 14 and 15. The door has a plurality of rollers 16 on the side edges 13 of each section received in and movable along guide rails or tracks 17. The guide rails are held to side jambs 18 of the door opening by brackets 19. Each guide rail has a vertical portion and a horizontal portion **17*a* which lies in a plane above the top of the door opening and held by brackets 20 and 21 suspended from ceiling or roof members of the garage. Brackets 21 at the end of each horizontal rail 17*a* are provided with U-bolts 22 which act as anchor means for one end of counterbalance springs 23. The opposite ends of springs 23 are each connected to a yoke 24 carrying a pulley 25. A fixed pulley 26 is mounted in a yoke 27 attached to the garage structure above the door opening. A cable 28 at each side of the door has one end attached to the adjacent bottom edge 15 and passes over fixed pulley 26, around pulley 25 and back to yoke 27 where it is dead ended. A safety cable 30 is attached at one end to each of U-bolts 22 or to the end of the spring at U-bolt 22 as in FIG. 2 and passed through the center of each of the counterbalance springs 23, through an opening 24*a* and 27*a* in each of yoke 24 and yoke 27 and the other end attached to adjustable anchor eye bolt 31 at yoke 27 by a clamp which may be a crimp clamp as shown or a U-bolt cable clamp or any other known cable clamp means. The eye bolt 31 is tightened until cable 30 is under tension sufficient to contain each of springs 23** against substantial vertical or horizontal movement in the event of breakage of either spring.

Figure 5:
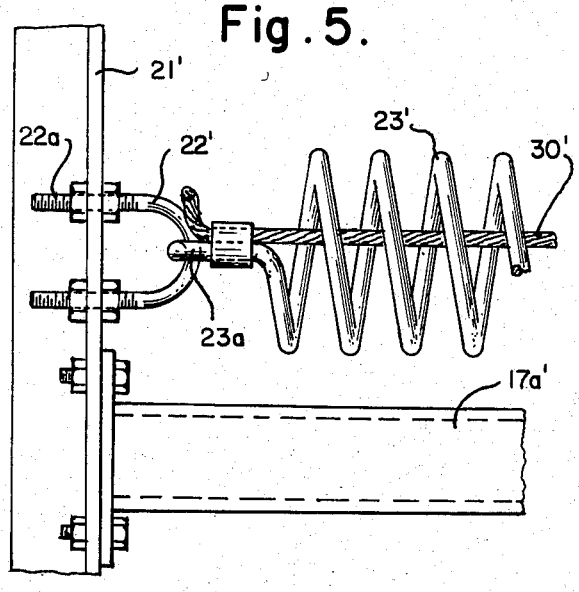
FIG. 5 is an enlarged fragmentary side elevation viewing a second embodiment of spring and anchor means opposite the adjustable anchor means.

In FIG. 5, I have illustrated an embodiment in which cable 30' is attached to the hook end 23*a* of spring 23' which engages the anchor bolt 22' so as to be an integral part of the counterbalance spring 23'.

Figure 6:
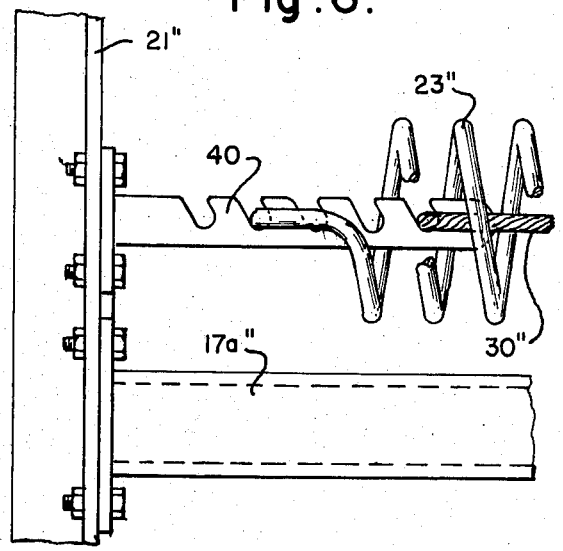
FIG. 6 is an enlarged fragmentary side elevational view of a third embodiment of anchor means remote from the adjustable anchor means.

In FIG. 6, I have illustrated another embodiment of end bracket 21'' for attaching and supporting horizontal guide rail 17*a''* and a notched anchor member 40 to which one end of counterbalance springs 23'' can be attached along with one end of safety cable 30''. In this embodiment the adjustable anchor would be the same.

The adjustable anchor would be arranged so that it is placed in support bracket 21 rather than at fixed pulley yoke 27 if desired. For example, the U-bolts 22 could have extended threaded leg portions 22*a* to provide adjustment. This could be the only adjustment or it could be combined with the adjustable eye bolt 31 to provide adjustment at each end of safety cable 30.

In the foregoing specification I have set out certain preferred practices and embodiments of this invention, however it will be understood that this invention may be otherwise embodied within the scope of the following claims.

I claim:

1. A garage or like door structure having a door opening, a door movable between a closed position and an open position, guide tracks adjacent opposite sides of the door opening, said guide tracks having a vertical section parallel to the sides of the door opening and a horizontal section transverse thereto above the top of the door opening, rollers on the sides of the door moving in said guide tracks to carry the door from a vertical closure position to a horizontal open position above the level of the door opening, a counterblance spring assembly for said door including a coil spring mounted for movement in tension parallel to and adjacent said horizontal guide rail section, anchor means in the garage structure adjacent the horizontal section of the guide tracks and spaced from the door opening, attaching means at each end of the coil spring, one attachement means at one end of the spring engaging said anchor means, a fixed pulley assembly including guide means on the garage structure above the door opening and in general alignment with the anchor means on a line generally parallel to the horizontal section of the guide rails, movable pulley assemby including guide means connected to the attachment means at the opposite end of the coil spring, lift cable means connecting said movable pulley assembly to the garage door over the fixed pulley, a safety cable extending through the open center of the coil spring and through the guide means of each of the fixed pulley assembly and movable pulley assemly, said safety cable aligned with the fixed pulley and anchor means, said safety cable being anchored at each end to said garage structure and adjusting means at one end of said safety cable for continuously placing the cable under sufficient tension that it will contain each of the coil spring, the fixed pulley assembly and the movable pulley assembly against substantial horizontal and vertical movement in the event of spring breakage.

2. A structure as claimed in claim 1 wherein the counterbalance spring assembly includes two coil springs one above each horizontal guide rail, each having an anchor means at one end, a movable pulley at the other end, a fixed pulley and lift cable associated with the movable pulley and a safety cable extending through the open center of each coil spring and through the guide means of each associated fixed pulley and movable pulley, said safety cable fastened at the opposite ends for adjustment at at least one end to provide sufficient tension on the safety cable so that it will contain each of the coil spring, the fixed pulley and the movable pulley against substantial horizontal and vertical movement in the event of spring breakage.

3. A structure as claimed in claim 1 or 2 wherein adjustment means are provided for the safety cable adjacent the fixed pulley.

4. A structure as claimed in claim 1 or 2 wherein adjustment means are provided for the safety cable adjacent the fixed pulley.

5. A structure as claimed in claim 1 or 2 wherein adjustment means are provided on the spring anchor means for receiving one end of the safety cable and applying tension thereto.

6. A structure as claimed in claim 1 or 2 wherein adjustment means are provided on the spring anchor means for receiving one end of the safety cable and applying tension thereto.

* * * * *